US007875803B2

(12) United States Patent
Sjöberg et al.

(10) Patent No.: US 7,875,803 B2
(45) Date of Patent: Jan. 25, 2011

(54) ELECTRIC BUSHING AND A METHOD OF MANUFACTURING AN ELECTRIC BUSHING

(75) Inventors: Peter Sjöberg, Ludvika (SE); Robert Ståhl, Ludvika (SE)

(73) Assignee: ABB Technology Ltd., Zürich (CH)

( * ) Notice: Subject to any disclaimer, the term of this patent is extended or adjusted under 35 U.S.C. 154(b) by 379 days.

(21) Appl. No.: 11/666,684

(22) PCT Filed: Nov. 1, 2005

(86) PCT No.: PCT/SE2005/001645

§ 371 (c)(1),
(2), (4) Date: Sep. 29, 2008

(87) PCT Pub. No.: WO2006/049567

PCT Pub. Date: May 11, 2006

(65) Prior Publication Data

US 2009/0032283 A1 Feb. 5, 2009

(30) Foreign Application Priority Data

Nov. 1, 2004 (SE) ..... 0402641.5

(51) Int. Cl.
*H01B 17/30* (2006.01)

(52) U.S. Cl. ..... 174/152 R; 174/153 R; 174/172; 174/650; 174/40 R; 139/39; 336/107

(58) Field of Classification Search ..... 174/152 R, 174/153 R, 172, 31 R, 140 R, 650; 439/371, 439/39; 336/107, 137, 198
See application file for complete search history.

(56) References Cited

U.S. PATENT DOCUMENTS

| | | | | |
|---|---|---|---|---|
| 3,314,030 | A | 4/1967 | Mallet et al. | |
| 3,775,547 | A | 11/1973 | Woods | |
| 6,610,933 | B2 * | 8/2003 | Baker et al. | 174/142 |
| 6,777,616 | B2 * | 8/2004 | Beele | 174/650 |
| 7,652,212 | B2 * | 1/2010 | Stacy | 174/152 R |

FOREIGN PATENT DOCUMENTS

| | | | |
|---|---|---|---|
| EP | 0200309 | A | 11/1986 |
| GB | 973433 | A | 10/1964 |
| WO | WO 00/55872 | A1 | 9/2000 |

OTHER PUBLICATIONS

PCT/ISA/210—International Search Report.
PCT/ISA/237—Written Opinion of the International Searching Authority.

* cited by examiner

*Primary Examiner*—Dhiru R Patel
(74) *Attorney, Agent, or Firm*—Venable LLP; Eric J. Franklin

(57) ABSTRACT

A bushing for electrical current and/or voltage through a grounded plane. A substantially rotationally symmetrical insulating body surrounds a central electrical conductor. The bushing includes a sealing member for gas/liquid sealing between the conductor and the insulator body. The bushing includes a compressible sealing element, which forms a gas/liquid seal, integrated with the insulating body, between the conductor and the insulating body. A method of manufacturing a bushing.

32 Claims, 2 Drawing Sheets

ELECTRIC BUSHING AND A METHOD OF MANUFACTURING AN ELECTRIC BUSHING

CROSS-REFERENCE TO RELATED APPLICATIONS

This application claims priority to Swedish patent application number 0402641-5 filed 1 Nov. 2004 and is the national phase under 35 U.S.C. §371 of PCT/SE2005/001645 filed 1 Nov. 2005.

TECHNICAL FIELD

The present invention relates to a bushing for electric current and/or voltage through a grounded plane, where a conductor is surrounded by an insulator body that is formed by impregnation and hardening of an insulating material that is wound around the conductor. The invention also relates to a method of manufacturing a bushing. The bushing according to the invention is used, for example in transformers, for connection of a transformer winding through the wall of a transformer tank to a distribution network. Other applications of the bushing are in cable terminations and gas-insulated equipment.

The invention also relates to a method of manufacturing a bushing.

BACKGROUND ART

In bushings, high demands are placed on the sealing between the conductor and the surrounding insulator body, so that no gas or liquid, for example transformer oil, may leak in the boundary layer between these.

WO 00/55872 discloses a bushing intended for connection to the wall of a transformer tank. The bushing according to the patent exhibits an insulator body 17 that is applied to a conductor 15. The patent relates to means to sealingly connect the bushing to the transformer housing. The problem with sealing between the insulator body and the conductor is not dealt with in the patent.

U.S. Pat. No. 3,775,547 discloses another example of a bushing exhibiting means integrated into the insulator body for connection of the bushing to a transformer housing. To solve the problem with sealing between the insulator and the conductor, it is proposed to attempt to adapt the coefficient of thermal expansion of the insulator material to the coefficient of thermal expansion of the conductor by supplying additives to the insulating material (column 3, lines 22 et seq.). The insulator body is here preferably made by casting and subsequent hardening of an epoxy material and is intended for lower voltages; a voltage level of 7 kV is, for example, mentioned in the patent. This solution of the leakage problem is not sufficient at the higher voltages to which the present invention relates.

In bushings for higher voltages, that is, above 36 kV and up to the highest system voltages occurring, 800 kV and above, difficulties of achieving satisfactory sealing arise since the size of the insulator body increases, which, among other things, in case of temperature variations, results in problems with sliding between the insulator body and the conductor due to the difference in the coefficient of temperature expansion of the material in the conductor, which usually consists of metal such as aluminum or copper or alloys thereof, and the material in the insulator. The contact between the insulator and the conductor may become released, which may then result in the occurrence of undesired leakage of gas/liquid.

It is common to apply a pressure-relieving layer, for example in the form of cork rubber, between the conductor and the insulator body. However, this layer does not ensure the sealing between the conductor and the insulator body, so the problems with leakage remain.

To ensure sealing, it is known to apply slots for seals, for example in the form of O-rings, at the end portions of the insulator. Such sealing measures are both complicated and costly in manufacture.

SUMMARY OF THE INVENTION

One aspect of the present invention is to provide a bushing that exhibits an effective seal between the insulator body of a bushing and the conductor.

Preferred embodiments are described in the subsequent subclaims. By the invention, a bushing with an integrated seal is achieved that is suitable for voltages up to the highest system voltages occurring (800 kV) and above while ensuring the sealing function for gas or liquid between the insulator body and the conductor, this seal being ensured also in case of major temperature variations.

Another aspect of the invention is to suggest a method of manufacturing a bushing.

DESCRIPTION OF THE PREFERRED EMBODIMENTS

According to one preferred embodiment, the sealing element at the bushing is designed as an annular band where the compressible means comprise grooves facing the conductor. One advantage with the grooves is that they will also under compressed condition slide against the surface of the conductor, during temperature change at the conductor and the insulation body, and still keep its sealing ability.

According to one preferred embodiment, the compressible means of sealing element comprise gas-filled cavities. Such cavities improve the elasticity of the sealing member.

According to one preferred embodiment, the compressible means of sealing element comprise groves as well as gas-filled cavities.

According to one embodiment, the sealing element is designed for geometric locking of the sealing element, for example in the form of locking grooves. The sealing element may alternatively exhibit a cross section with a thickness increasing in a direction towards the centre of the bushing for forming such locking.

According to another preferred embodiment, the sealing element is arranged at the outer end of the insulator body and is provided with a lip facing this end, which during the manufacturing process serves as a flexible spacer that attends to removal of force between the conductor and the outer end of the insulator body.

The sealing element consists of rubber or a rubber-like material that exhibits chemical resistance to gas or liquid. In non-compressed state, the sealing element preferably exhibits a largest thickness of between 0.5 and 10 mm and a width of between 10 and 100 mm as well as an inner diameter of between 20 and 300 mm, which diameter is somewhat smaller than the outer diameter of the electrical conductor.

According to one preferred embodiment, the bushing according to the invention is designed for a lowest system voltage of 36 kV, alternatively from 170 kV up to the highest system voltages occurring, that is, 800 kV and above, which means that the insulator body is dimensioned for this.

According to one embodiment, the insulator body comprises, in addition to insulating material, also means for field control, for example in the form of field-controlling linings.

According to one preferred embodiment, the bushing according to the invention is arranged in a transformer and there constitutes part of its electrical connection to a force line, whereby the grounded plane consists of the wall in a transformer tank. The bushing may also be arranged in gas-insulated equipment, whereby the grounded plane consists of the enclosure around the insulating gas. Alternatively, the bushing constitutes part of a cable termination, whereby the grounded plane consists of a ground casing in a cable segment.

According to a second aspect of the invention, a method for manufacturing a bushing for electric current and/or voltage through a grounded plane is suggested.

This is achieved by a method according to the characterizing portion of claim 14.

According to a preferred method, the sealing element consisting of rubber or a rubber-like material is compressed by deformation of its compressible means comprising grooves making contact with the conductor.

According to a preferred method, the sealing element is compressed by deformation of its compressible means comprising cavities.

According to a preferred method, the sealing element is compressed by deformation of grooves as well as gas-filled cavities.

According to a preferred method, after the hardening process, the final shape is imparted to the bushing by machining, for example by turning in a lathe.

According to a preferred method, the end of the sealing element facing the outer end of the insulator body is formed with a lip which is exposed or removed during the machining of the insulator body.

According to a preferred method, means for field control for example in the form of field-controlling linings are wound into the insulator body between the insulating materials.

According to a preferred method, a pressure-equalizing layer is applied between part of the conductor and the insulator body.

According to a preferred method, the manufacturing process is adapted to the manufacture of a bushing for a lowest system voltage of 36 kV, alternatively from 170 kV and up to the highest currently occurring system voltages, that is, 800 kV and above.

BRIEF DESCRIPTION OF THE DRAWINGS

The invention will now be described with reference to the accompanying drawings, wherein.

FIGURE DESIGNATIONS

Figure 1:
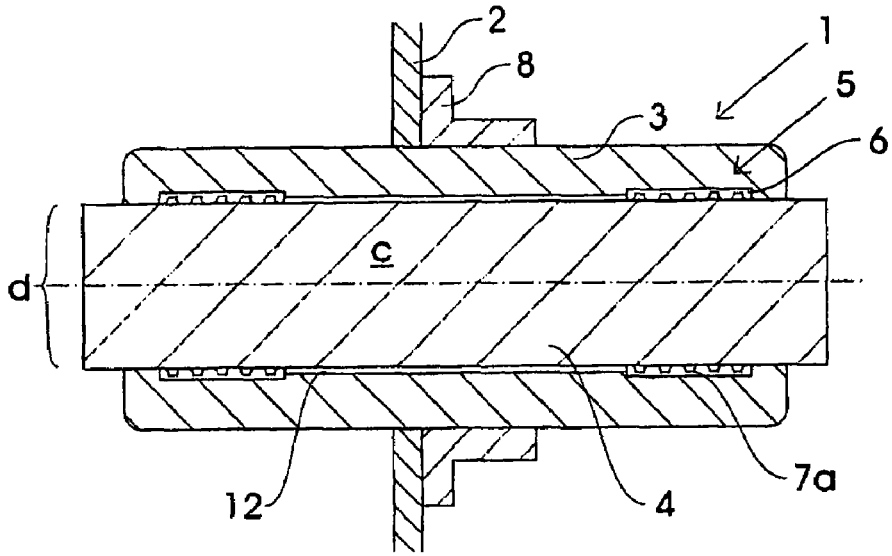
FIG. 1 shows a section of a bushing according to the invention.

1 bushing
2 grounded plane
3 insulator body
4 electrical conductor
5 sealing member
6 sealing element
7*a* grooves
7*b* gas-filled cavities
8 fixing element
9 outer end of insulator body
10 lip
11 field-controlling lining
12 pressure-reliving layer
13 locking grooves
14 transformer
15 transformer winding
16 force line
17 transformer tank
18 insulator

DETAILED DESCRIPTION OF THE DRAWINGS

FIG. 1 shows a bushing 1 for electric current and/or voltage through a grounded plane 2. The grounded plane may, for example, constitute part of a transformer tank, to which the bushing, which is provided with fixing element 8, is sealingly attached (by suitable means not shown).

The bushing 1 comprises a substantially rotationally symmetrical insulating body 3 surrounding a central electrical conductor 4. The conductor is usually made of a metallic material, such as aluminum or copper or alloys thereof, but may also consist of other conductive material.

The bushing is provided with a sealing member 5 to achieve gas/liquid sealing between the conductor and the insulator body 3. The insulator body is formed by winding insulating material (e.g. insulating paper) on the conductor in a known way and then impregnating it with a hardening material, for example epoxy. By a hardening process, the insulator body assumes a solid shape in the form of a so-called RIP (Resin Impregnated Paper) body. A pressure-relieving layer 12, for example in the form of cork rubber, may be applied to the conductor between parts of the boundary layer between the conductor and the insulating body. However, this layer does not ensure the sealing function but has a pressure-relieving function.

According to the invention, the sealing member 5 comprises at least one sealing element 6 with compressible means, which sealing element is arranged on the conductor between the insulating body 3 and the conductor 4, to which sealing element, during said hardening process, a compressed state has been imparted by the externally arranged insulator body 3, the sealing element then forming a gas/liquid seal, integrated with the insulating body, between the conductor 4 and the insulating body 3. The sealing element, which consists of a rubber material or a rubber-like material of a quality suited for the purpose, is shaped as an annular band. To impart a permanently compressed state to the sealing element, the sealing element is provided with compressible means. According to one embodiment of the invention, the compressible means comprise grooves 7*a* facing the conductor, said grooves being deformed during the compression process. According to another embodiment of the invention, the compressible means of the sealing element 6 comprise gas-filled cavities 7*a* that are compressed and deformed during the compression. A combination of these methods of imparting a permanent compression to the sealing element by deforming groves 7*a* and gas-filled cavities 7*b* is possible within the scope of the invention.

According to the invention, sealing member 5 comprises at least one sealing element 6 with compressible means arranged on a part of the axial lengths of the conductor 4. Preferably, sealing elements can be arranged at both ends of the insulating body. Alternatively, sealing element 6 can be arranged between the ends of the insulating body or at the ends as well as in-between the ends.

Figure 2:
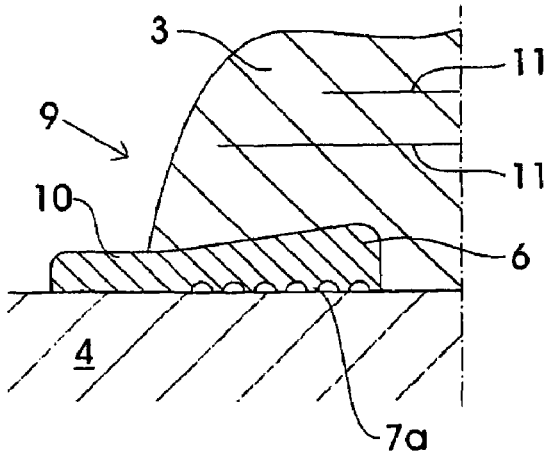
FIG. 2 shows in detail a section of the sealing element at the outer end of the bushing.

FIG. 2 shows in detail a section of the sealing element 6 at the outer end of the bushing 1. Here, the sealing element 6 is formed with a cross section with an increasing thickness in a direction towards the centre c of the bushing 1 and a corresponding void formed in the insulator body. This implies that geometrical locking of the sealing element is achieved when an overpressure of gas or liquid from the centre of the bushing towards the ends brings about an axial force on the seal against the outer end thereof.

Further, FIG. 2 shows that the sealing element 6 is provided with a lip 10 facing the outer end of the insulator. This lip serves as a flexible spacer that attends to the relief of force between the conductor 3 and the outer end 9 of the insulator body. 12 designates a pressure-relieving layer.

Figure 2A:
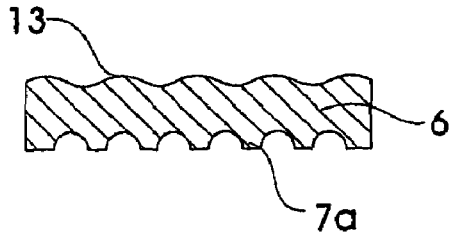
FIG. 2*a* shows in detail a section of the sealing element with locking grooves.

FIG. 2*a* shows a section of the sealing element 6, where the geometrical locking against the insulator is achieved by means of locking grooves 13. The locking grooves 13 are waved in the figure. The compressible means here comprise grooves 7*a*.

Figure 2B:
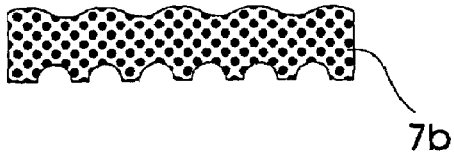
FIG. 2*b* shows in detail a segment of the sealing element with compressible gas cavities.

FIG. 2*b* shows a section of the sealing element 6 similar to FIG. 2*a*, where the compressible means comprise gas-filled cavities 7*b* as well as grooves 7*a*.

Figure 3:
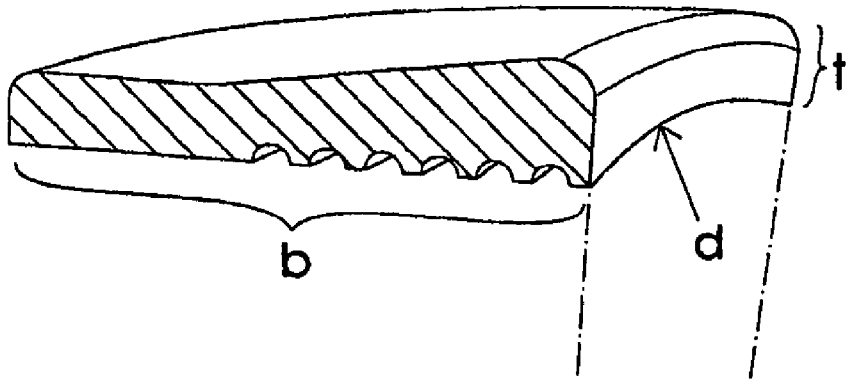
FIG. 3 shows in detail a segment of the sealing element, FIG. 4 schematically shows the bushing arranged in the transformer tank of a transformer.

FIG. 3 shows a section of a segment of the sealing element 6, which in non-compressed state exhibits a largest thickness t of between 0.5 and 10 mm and a width b of between 10 and 100 mm, as well as an inner diameter d of between 20 and 300 mm, said diameter being somewhat smaller than the outer diameter D of the electrical conductor (FIG. 1).

The sealing element 6 in FIGS. 2 and 3 can also be provided with gas-filled cavities 7*b* as shown in FIG. 2*b*.

The bushing is preferably designed for a lowest system voltage of from 36 kV, alternatively from 170 kV and up to the highest system voltages occurring, that is, 800 kV and above. In these applications, it is suitable for the insulator body 3 to comprise, in addition to insulating material, also means for field control, for example in the form of field-controlling linings 11, which is schematically shown in FIG. 2.

Figure 4:
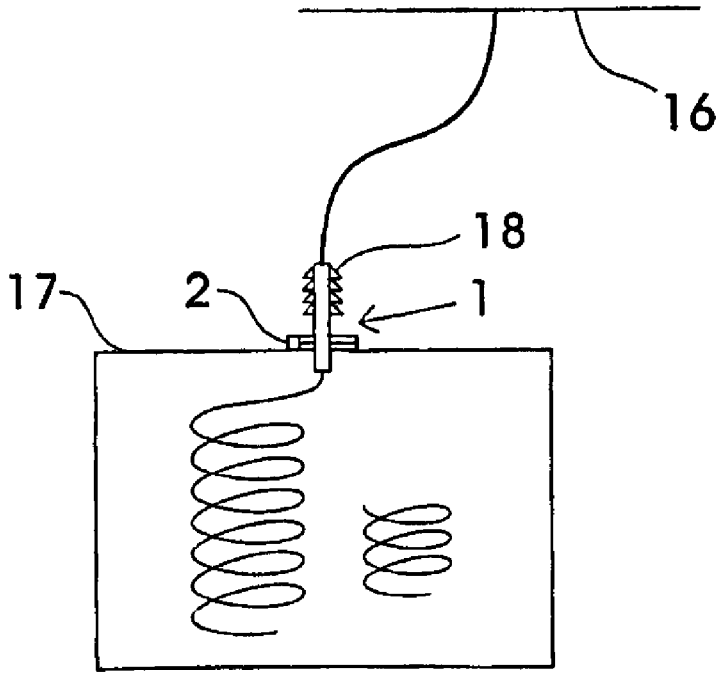

In FIG. 4, the bushing 1 according to the invention is shown arranged in a transformer 14 and constitutes part of its electrical connection between the transformer winding 15 and a force line 16. Here, the grounded plane 2 consists of the wall of a transformer tank 17. 18 designates an insulator connected to the bushing.

Alternatively, the bushing may be arranged with gas-insulated equipment (not shown), where the grounded plane 2 consists of the enclosure around the insulating gas.

Where the bushing constitutes part of a cable termination (not shown), the grounded plane 2 is in the form of a ground casing in the cable segment that is connected to the cable termination.

When the sealing element 6 is placed at the outer end of the insulator body as described above, a sealing element is preferably attached at each outer end of the insulator body. Alternatively, the sealing element may be centrally located. In this case, the sealing element is preferably formed without a lip 10.

The invention also relates to a method of manufacturing a bushing 1 for electric current and/or voltage through a grounded plane 2 according to the above.

The bushing thus comprises a substantially rotationally symmetrical insulating body 3 surrounding a central electrical conductor 4 that exhibits sealing members 5 for gas/liquid sealing between the conductor 4 and the insulator body 3. Such an insulator body 3 is formed using known technique such that an insulating material, for example in the form of insulating paper, is wound onto the conductor (or onto a pressure-relieving layer possibly applied thereon). Thereafter, the insulator body is impregnated with a hardening material, for example epoxy, whereupon it is changed into solid shape by a hardening process. During this process, shrinkage of the insulating material, so-called hardening shrinkage, occurs, which causes the insulating body to become attached to the envelope surface of the conductor and sealing thereagainst.

In bushings for higher voltages and currents, they have to be dimensioned accordingly, which means that such bushings assume larger dimensions. From this follows, in turn, that the contact surface along the insulator body and the axial extent of the conductor may become considerable, for example 1-2 meters.

Since the coefficient of temperature expansion is not identical for the conductor material and the insulator material, respectively, shear forces will arise at the boundary layer as a result of temperature variations, which implies that the seal cannot be maintained between the conductor and the insulator material, which results in gas/liquid leakage therebetween.

According to the method of manufacturing the bushing according to the invention, a sealing member 5 in the form of a compressible elastic sealing element 6 is applied to the conductor 4 prior to winding on the insulating material. The insulating material is applied so as to at least substantially cover the sealing element 6, whereupon a permanent and substantially radial compressive force is imparted to the sealing element during the subsequent manufacturing process from the surrounding insulator body 3, whereby the sealing element 6 in its compressed state serves as a gas/liquid seal between the conductor 4 and the insulator body 3.

The sealing element 6 is made of rubber or a rubber-like material, and for the compression to become permanent it is important that the material be given space for deformation. Since the sealing element is provided with compressible means such as grooves 7*a*, which compressible means are elastically deformed during compression, space for expansion is provided between these grooves.

Alternatively, the compressible means of sealing element 6 contain air or gas-filled cavities that are compressed.

Alternatively, the compressible means of sealing element 6 comprise grooves 7*a* as well as air or gas-filled cavities 7*b*.

After the hardening process, the bushing is given its final shape by machining the insulator, for example by turning the insulator to the desired shape in a lathe.

When the sealing element is arranged at the outer end 9 of the insulator body, it is preferably formed with a lip 10 which, when the insulating material is being wound on, is allowed completely or partly to cover this end. During the machining of the insulator body 3, the lip is exposed, or alternatively removed. By this method, mechanical stress concentrations at the outer end 9 of the insulator body are avoided.

At the high electric voltages to which the bushing is designed, means for field control are normally required, for example in the form of field-controlling linings 11, which in a known manner are wound into the insulator body 3 between the insulating material.

The manufacturing process is preferably suited for manufacture of bushings for a lowest system voltage of 36 kV, alternatively from 170 kV up to the highest system voltages currently occurring, 800 kV and above, but according to the invention is it also suitable for manufacture of bushings for lower electric voltages.

The invention claimed is:

1. A bushing for at least one of electric current or voltage through a grounded plane, comprising:

a substantially rotationally symmetrical insulating body surrounding a central electrical conductor, said bushing comprising a sealing member for gas/liquid sealing between the conductor and the insulating body, said insulating body comprising insulating material wound onto the conductor and impregnated with a hardening material, and being transferred into solid shape by a hardening process, wherein said sealing member comprises at least one sealing element comprising a compressible member arranged on a part of an axial direction of the conductor between the insulating body and the conductor, a compressed state being imparted to the sealing element during said hardening process by the insulating body, said sealing element forming a gas/liquid seal, integrated with the insulating body, between the conductor and the insulating body.

2. The bushing according to claim 1, wherein the compressible member of the sealing element comprises grooves formed on an annular band, wherein the grooves are arranged perpendicular to the axial direction of the conductor facing the axial direction of the conductor.

3. The bushing according to claim 1, wherein the compressible member of the sealing element comprises gas filled cavities.

4. The bushing according to claim 1, wherein the compressible member of the sealing element comprises grooves and gas-filled cavities.

5. The bushing according to claim 1, wherein the sealing element has a cross section with an increasing thickness in a direction towards a center of the bushing for geometrically locking the sealing element.

6. The bushing according to claim 1, wherein the sealing element is arranged at an outer end of the insulating body and is arranged towards the outer end with a lip, which during a process for manufacturing the bushing serves as a flexible spacer that relieves force between the conductor and the outer end of the insulating body.

7. The bushing according to claim 1, wherein the sealing element comprises rubber.

8. The bushing according to claim 1, wherein the sealing element in a non-compressed state has a largest thickness of between 0.5 and 10 millimeters, a width of between 10 and 100 millimeters, and an inner diameter of between 20 and 300 millimeters, said diameter being somewhat smaller than an outer diameter of the conductor.

9. The bushing according to claim 1, wherein the bushing is designed for a lowest system voltage of 36 kilovolts and up to a highest system voltage of at least 800 kilovolts.

10. The bushing according to claim 1, wherein the insulating body further comprises a field control element.

11. The bushing according to claim 10, wherein the field control element comprises field-controlling linings.

12. The bushing according to claim 1, wherein the bushing is arranged in a transformer and is part of an electrical connection of the transformer to a force line, whereby the grounded plane comprises a wall of a transformer tank.

13. The bushing according to claim 1, further comprising:

gas-insulated equipment, whereby the grounded plane comprises an enclosure around an insulating gas.

14. The bushing according to claim 1, wherein the bushing comprises part of a cable termination, whereby the grounded plane comprises a ground casing in a cable segment.

15. The bushing according to claim 1, wherein the insulating material comprises insulating paper.

16. The bushing according to claim 1, wherein the hardening material comprises-epoxy.

17. The bushing according to claim 1, wherein the bushing is designed for a lowest system voltage of 170 kilovolts and up to a highest system voltage of at least 800 kilovolts.

18. A method for manufacturing a bushing for at least one of electric current or voltage through a grounded plane comprising a substantially rotationally symmetrical insulating body surrounding a central electrical conductor, said bushing comprising a sealing member for gas/liquid sealing between the conductor and the insulating body, the method comprising:

forming said insulating body by winding insulating material onto the conductor, impregnating said insulating body with a hardening material, transferring the insulting body into solid shape by a hardening process, said sealing member comprising at least one sealing element comprising a compressible member applied to a part of axial direction of the conductor between the insulating body and the conductor prior to the winding of the insulating material, said material being applied so as to cover the sealing element, and imparting a permanent and substantially radial compressive force to the sealing element with the compressible member during the subsequent manufacturing process by the insulating body, whereby the sealing element in a compressed state serves as the gas/liquid seal between the conductor and the insulator body.

19. The method according to claim 18, wherein the sealing element comprises rubber and is compressed by deformation of the compressible member comprising grooves making contact with the conductor.

20. The method according to claim 18, wherein the sealing element comprises rubber and is compressed by deformation of the compressible member comprising cavities which are compressed.

21. The method according to claim 18, wherein the sealing element is compressed by deformation of grooves and gas-filled cavities.

22. The method according to claim 18, wherein after the hardening process, a final shape is imparted to the bushing by a machining.

23. The method according to claim 22, wherein the machining comprises turning in a lathe.

24. The method according to claim 18, wherein an end of the sealing element facing an outer end of the insulating body is formed with a lip, wherein said lip, during the machining of the insulating body, is exposed, alternatively removed.

25. The method according to claim 18, further comprising:

winding a field control element into the insulator body between the insulating material.

26. The method according to claim 25, wherein the field control element comprises field-controlling linings.

27. The method according to claim 18, wherein a pressure-equalizing layer is applied between part of the conductor and the insulator body.

28. The method according to claim 18, wherein the method is adapted to manufacturing of a bushing for a lowest system voltage of 36 kilovolts and up to a highest system voltage of at least 800 kilovolts.

29. The method according to claim 18, wherein the insulating material comprises insulating paper.

30. The method according to claim 18, wherein the hardening material comprises-epoxy.

31. The method for manufacturing a bushing according to claim 18, wherein the hardening process comprises hardening shrinkage.

32. The method according to claim 18, wherein the method is adapted to manufacturing of a bushing for a lowest system voltage of 170 kilovolts and up to a highest voltage of at least 800 kV kilovolts.

* * * * *